United States Patent [19]

Stevenson

[11] 4,182,520

[45] Jan. 8, 1980

[54] SKATEBOARD STRUCTURE

[76] Inventor: Richard L. Stevenson, 738 Loma Vista, El Segundo, Calif. 90245

[21] Appl. No.: 927,150

[22] Filed: Jul. 24, 1978

[51] Int. Cl.[2] ..... A63C 1/00

[52] U.S. Cl. ..... 280/87.04 A; 293/142

[58] Field of Search ..... 280/87.04 A, 87.04 R, 280/11.28, 11.19, 610, 608, 11.37 E; 9/310 E, 310 A, 310 R; 293/142, 155; 52/783, 810, 811, 829

[56] References Cited

U.S. PATENT DOCUMENTS

| | | | |
|---|---|---|---|
| 1,532,487 | 4/1925 | Hayes | 293/142 |
| 3,201,138 | 8/1965 | Brown, Jr. | 280/610 |
| 3,736,609 | 6/1973 | Saucier | 280/610 |
| 3,795,409 | 3/1974 | Cudmore | 280/87.04 A |
| 3,871,671 | 3/1975 | Bildner | 280/608 |
| 4,129,911 | 12/1978 | McDonald et al. | 9/310 E |

FOREIGN PATENT DOCUMENTS

| | | | |
|---|---|---|---|
| 2649203 | 5/1978 | Fed. Rep. of Germany | 280/87.04 A |
| 2361134 | 3/1978 | France | 280/87.04 A |
| 610604 | 10/1948 | United Kingdom | 280/87.04 A |

OTHER PUBLICATIONS

"Introducing the Hot Streaks," Skateboarder Magazine, Jul. 1978, pp. 24–25, vol. 4, No. 12.

*Primary Examiner*—David M. Mitchell
*Attorney, Agent, or Firm*—Keith D. Beecher

[57] ABSTRACT

A skateboard structure is provided which has a central platform formed of a top piece and a bottom piece. The two pieces may be formed of plastic or other appropriate material, and each piece may be shaped to define an inner surface of cellular configuration so that when the two pieces are fitted together they define an internal reinforcing honeycomb-like core. A bumper formed of appropriate resilient material, such as rubber or plastic, is provided which extends around the periphery of the two pieces of the central platform, and which has a web-like integral section extending inwardly between the two pieces to be clamped therebetween, so that the bumper may be held firmly in place. The bumper itself may have a variety of shapes, so that a common central two-piece platform may be used to provide a variety of skateboard shapes and models merely by selecting appropriate bumpers.

6 Claims, 9 Drawing Figures

SKATEBOARD STRUCTURE

RELATED COPENDING APPLICATIONS

Ser. No. 883,726—Stevenson, Filed Mar. 6, 1978 and now abandoned.

BACKGROUND

Skateboards have developed from an original, relatively simple construction comprising a board with roller skate trucks mounted at each end thereof, to plastic and wood constructions of a variety of shapes and sizes. Plastic skateboards are presently preferred from a cost and durability standpoint. However, to make large functional skateboards out of a single plastic piece requires massive size, excessive weight, and disproportionate high cost. Skateboards with solid foam cores wrapped with fiberglass are presently available, but they too are extremely expensive.

The copending application described above provides a low cost, good-looking, light and sturdy skateboard which may be formed by injection molding. As described in the application, the skateboard is constructed by providing a two-piece injection molded plastic structure with a honeycomb-like core. With such a construction, the desired strength is achieved without the need for the resulting skateboard structure to be unduly expensive, massive, heavy or thick, and yet it still maintains optimum rigidity and strength.

The construction of the copending application also permits color combinations impossible in the low cost prior art one-piece boards. Also, the construction of the structure described in the copending application permits the pieces of the plastic platform to be post-formed during the cooling cycle of the injection molding in induce curvatures into the resulting structure favorable for marketing purposes.

In accordance with the present invention, a two-piece skateboard structure such as disclosed in the copending application is used in conjunction with a peripheral bumper, not only to provide a structure which is protected from impacts, but also to enable a variety of skateboard models to be made merely by selecting bumpers of different shapes and sizes for use in conjunction with a common central two-piece platform.

An objective of the present invention, therefore, is to provide a skateboard structure by which a variety of different skateboard shapes may be achieved at low cost. When plastic is used as the two-piece central platform section, an initial mold may be purchased and used to produce the central platform. This mold can be used without change over the years in the production of skateboards. When a new skateboard model is desired, a simple and inexpensive mold may be obtained to produce bumpers of new shapes to be used with the original central two-piece platform.

Moreover, the bumpers, in a variety of shapes may be sold separately so that the purchasers can change their skateboard models at will, merely by removing the old bumper and replacing it with a new one. Such replacement does not entail any special skill or require any special tools. The original skateboard can be taken apart merely by removing its screws with a screwdriver, and its bumper replaced with a new bumper. Then, the assembly can be put together again merely by replacing the screws.

The construction of the present invention also permits the top surface of the central platform to be recessed with respect to the top edge of the bumper. Then, a strip of material can be attached to the top surface of the central platform to be flush with the top of the bumper. This latter strip may be, for example, a piece of non-skid material, wood veneer, fiberglass, aluminum and the like. This latter feature provides another opportunity to produce a variety of different models of skateboards all in conjunction with the common two-piece central platform.

A feature of the skateboard structure of the invention in the embodiment to be described is that the trucks are supported in recessed wells in the underside of the lower piece of the central platform. This lowers the center of gravity of the board materially despite the fact that the board itself is relatively thick as compared with some of the prior art boards.

DETAILED DESCRIPTION OF THE ILLUSTRATED EMBODIMENT

Figure 1:
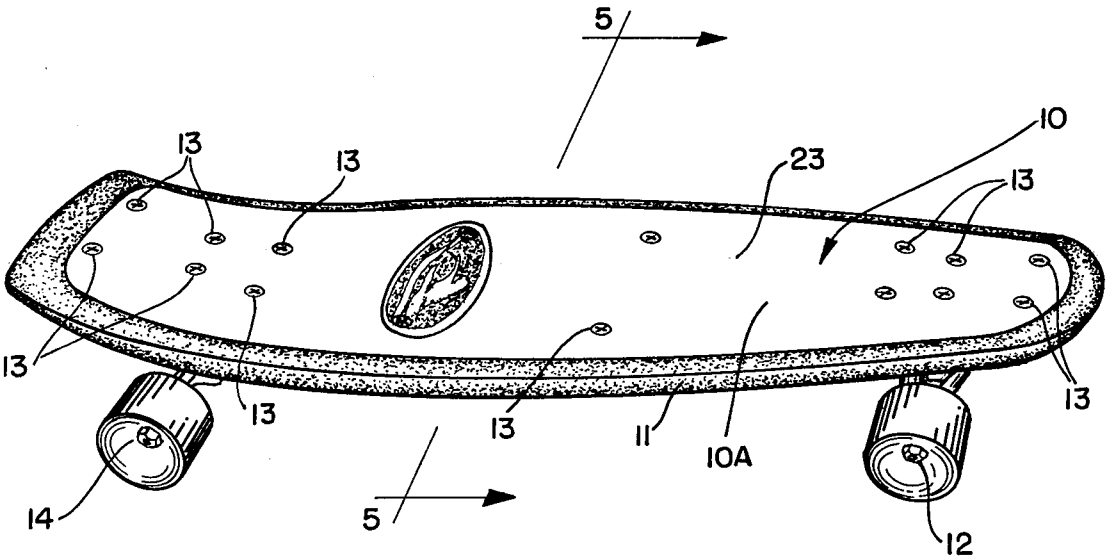
FIG. 1 is a top perspective view of a skateboard constructed in accordance with one embodiment of the invention.
Figure 2:
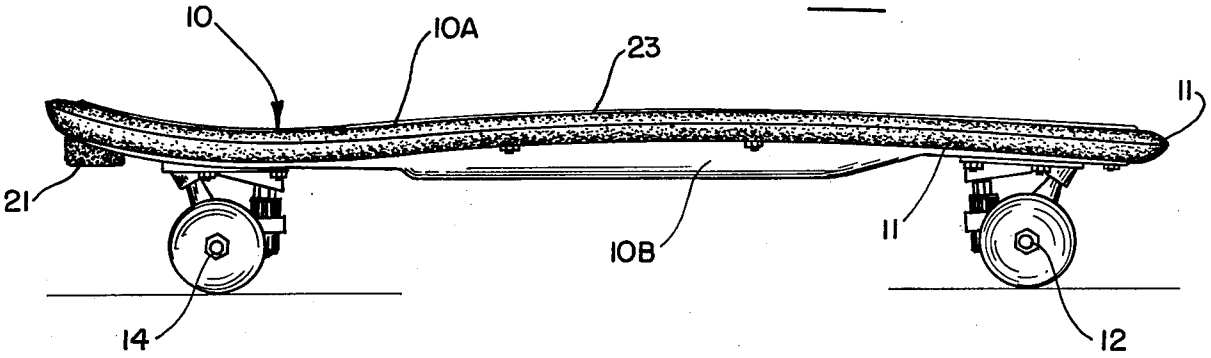
FIG. 2 is a side perspective view of the board of FIG. 1.
Figure 3:
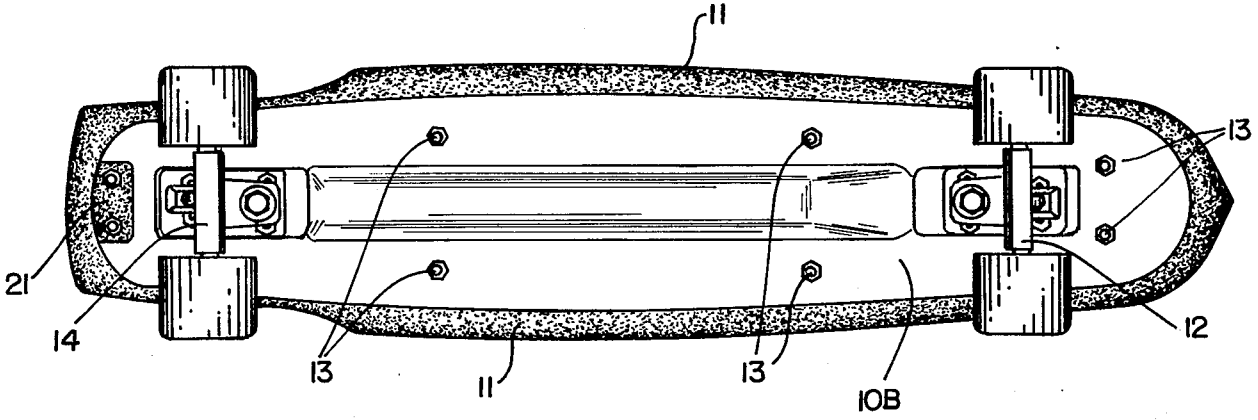
FIG. 3 is a bottom view of the skateboard of FIGS. 1 and 2, showing the recessed support areas for the trucks.

As shown in FIGS. 1–3, the skateboard of the invention includes a central platform 10, with rollerskate trucks 12 and 14 mounted at each end. As best shown in FIG. 2, the trucks are mounted on the bottom of the skateboard in recessed wells, so as to lower the center of gravity of the structure as much as possible.

Figure 6:
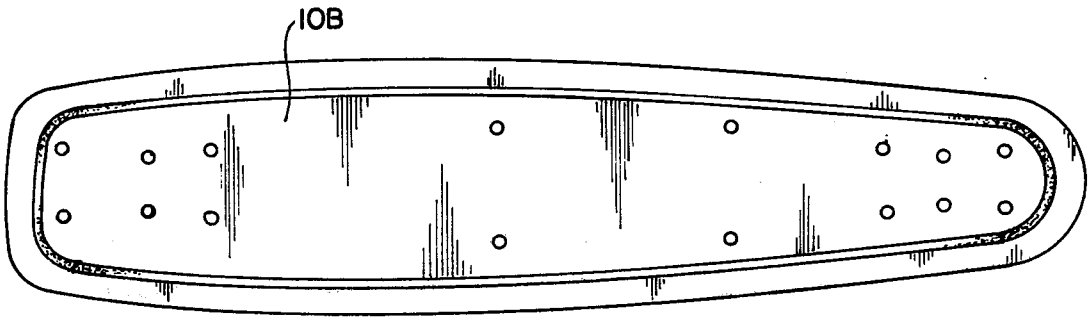
FIG. 6 is a plan view of the bottom piece of the central platform of the skateboard of FIGS. 1–3.
Figure 7:
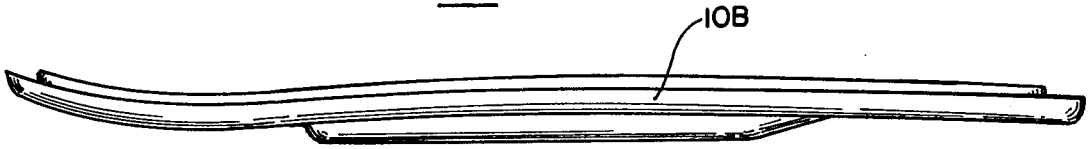
FIG. 7 is a side view of the bottom piece of the central platform.
Figure 8:
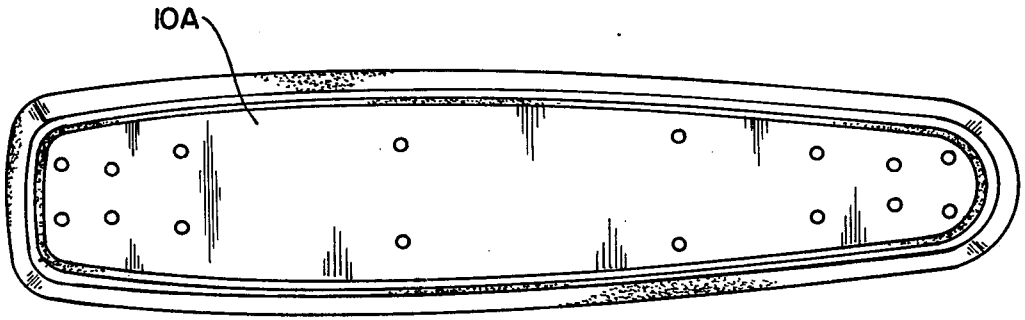
FIG. 8 is a bottom view of the top piece of the central platform of the skateboard of FIGS. 1–3.
Figure 9:
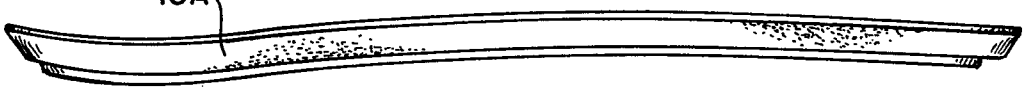
FIG. 9 is a side view of the top piece of the platform.

The platform 10 includes a top piece 10A (FIGS. 8 and 9) and a bottom piece 10B (FIGS. 6 and 7). These two pieces may be formed of injection molded plastic material such as polypropylene, polyethylene, polycarbonate, plexiglass, or other suitable plastic material which is susceptible to injection molding. The two pieces are held together by bolts 13, as shown in FIGS. 1–3.

Figure 4:
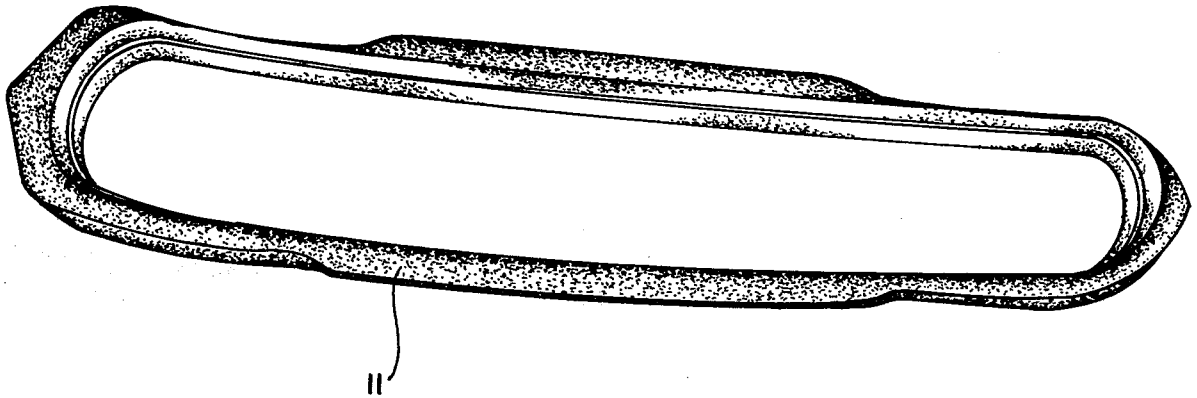
FIG. 4 is a perspective view of a bumper which is clamped between the two pieces of the central platform of the skateboard of FIGS. 1–3, and which extends around the periphery thereof.
Figure 5:
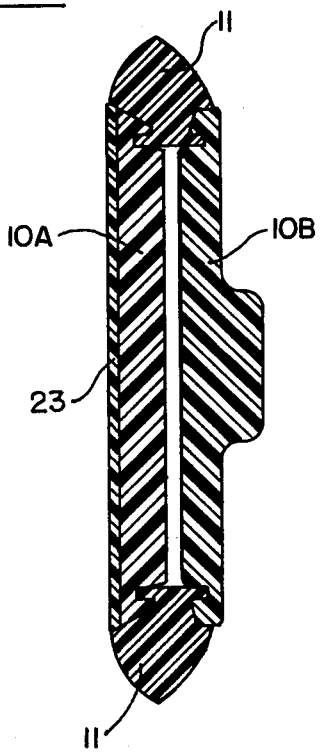
FIG. 5 is a cross-section of the skateboard of FIG. 1, taken essentially along the line 5—5 of FIG. 1.

A bumper 11, as shown in FIG. 4, is mounted on the assembly of FIGS. 1–3, and extends completely around the periphery of the assembly. The bumper 11 is held in place by an integral web portion which extends between the two pieces of the board, as best shown in FIG. 5.

As described above, the top surface of the top piece 10A may be recessed with respect to the top of the bumper 11, and a strip 23, for example, of non-skid material may be attached to the top surface of the piece 10A, or any other strip of appropriate material may be attached thereto.

The structure may also include a skeg 21 attached to the underside of its rear edge to prevent damage to the underside of the bottom piece of the central platform.

As described above, the bumper 11 which is clamped between the two pieces protects the central core from impacts, and also provides a means for manufacturing a variety of skateboard models at a realtively low cost, maintaining a common central platform. Also, as described, the central platform may be recessed with respect to the top of the bumper, so that a variety of strips of different materials may be affixed to the top surface of the board, further to provide an inexpensive means for producing a variety of models, all including a common central platform.

While a particular embodiment of the invention has been shown and described, modifications may be made. It is intended in the claims to cover the modifications which come within the spirit and scope of the invention.

What is claimed is:

1. A skateboard structure comprising a platform formed of a top piece and a bottom piece separate from one another; a bumper extending around the periphery of the platform and having an integral web section extending between the top piece and the bottom piece of the platform; and a plurality of bolts extending through the top piece and the bottom piece for securing the top piece and the bottom piece of the platform together and for clamping the web section of the bumper therebetween.

2. The skateboard structure defined in claim 1, in which the bumper is formed of a selected resilient material.

3. The skateboard structure defined in claim 1, in which the bottom piece has recessed wells formed in the lower surface thereof at each end of the platform; and first and second trucks mounted in the wells.

4. The skateboard structure defined in claim 1, and which includes a strip of a selected material mounted on the upper surface of the top piece.

5. The skateboard structure defined in claim 1, in which the upper surface of the top piece is recessed down from the top of the bumper.

6. The skateboard structure defined in claim 5, and which includes a strip of selected material mounted on the upper surface of the top piece with its upper surface flush with the top of the bumper.

* * * * *